US008453835B2

(12) United States Patent
So

(10) Patent No.: US 8,453,835 B2
(45) Date of Patent: Jun. 4, 2013

(54) PROTECTIVE COVER FOR COMMUNICATION DEVICE

(76) Inventor: Kar Ming So, Kowloon (HK)

( * ) Notice: Subject to any disclaimer, the term of this patent is extended or adjusted under 35 U.S.C. 154(b) by 248 days.

(21) Appl. No.: 13/019,019

(22) Filed: Feb. 1, 2011

(65) Prior Publication Data

US 2012/0000908 A1 Jan. 5, 2012

Related U.S. Application Data

(63) Continuation-in-part of application No. 13/018,929, filed on Feb. 1, 2011.

(60) Provisional application No. 61/358,198, filed on Jun. 24, 2010, provisional application No. 61/390,351, filed on Oct. 6, 2010.

(51) Int. Cl.
*G06F 1/1637* (2006.01)
*G06F 1/1656* (2006.01)

(52) U.S. Cl.
USPC ..... 206/320; 361/679.56; 361/679.57; 361/679.55; 361/679.3; 206/701; 206/316.2; 206/811; 206/305; 220/692; 220/622; 220/784; 220/788; 220/560; 220/212; 220/782; 455/575.1; 455/128; 292/DIG. 47; 292/301; 292/294

(58) Field of Classification Search
USPC ..... 361/686, 683, 679.01, 679.56, 679.57, 361/679.55; 206/701, 320, 316.2, 324, 811, 206/305, 1.5, 450; 463/46; 63/1.14; 220/692, 220/622, 784, 788, 560, 212, 1.5, 782; 109/49; 455/575.1, 128; 292/99, 1, 137, DIG. 11, 292/DIG. 38, DIG. 63, 194, 195, 197
See application file for complete search history.

(56) References Cited

U.S. PATENT DOCUMENTS

| | | | | | |
|---|---|---|---|---|---|
| 4,097,878 | A | * | 6/1978 | Cramer | 396/27 |
| D283,138 | S | * | 3/1986 | Hamar | D18/11 |
| 5,002,184 | A | * | 3/1991 | Lloyd | 206/305 |
| D316,932 | S | * | 5/1991 | Escher, Jr. | D3/265 |
| 5,251,104 | A | * | 10/1993 | Wandt et al. | 361/736 |
| 5,511,390 | A | * | 4/1996 | Mah | 63/1.14 |
| 5,570,780 | A | * | 11/1996 | Miller | 206/305 |
| 5,907,721 | A | * | 5/1999 | Schelling et al. | 396/27 |

(Continued)

OTHER PUBLICATIONS

Amazon.com Listing for Aqua Box cell phone case. Accessed Nov. 4, 2012. http://www.amazon.com/Aqua-Box-Waterproof-Yellow-Packaging/dp/B004QE6R6M.*

*Primary Examiner* — Mickey Yu
*Assistant Examiner* — Gideon Weinerth
(74) *Attorney, Agent, or Firm* — Ronald E. Smith; Smith & Hopen, P.A.

(57) ABSTRACT

A water-proof container for holding a mobile device includes a base adapted to support a mobile device, a cover, a hinge for interconnecting the base and cover to one another, and a locking mechanism for locking the cover to the base. A groove is formed in an interior wall of the cover in circumscribing relation to the cover. A thin, transparent sheet of plastic has a bead formed in its peripheral edge and the bead is press fit into the groove so that the thin sheet of plastic closely overlies the operative face of the mobile device when the cover is latched to the base. A hollow lock housing is pivotally mounted about a pivot pin. A one hundred eighty degree (180°) rotation of the lock housing positions the opening on an opposite side of the container 10, capturing the latch.

7 Claims, 11 Drawing Sheets

U.S. PATENT DOCUMENTS 5,996,956 A * 12/1999 Shawver ..... 248/309.1
6,003,831 A * 12/1999 Coleman ..... 248/688
6,028,765 A * 2/2000 Swindler et al. ..... 361/679.55
6,068,119 A * 5/2000 Derr et al. ..... 206/305
6,092,707 A * 7/2000 Bowes, Jr. ..... 224/435
6,206,187 B1 * 3/2001 Van Winkle ..... 206/320
6,646,866 B2 * 11/2003 Kao ..... 361/679.26
6,726,070 B2 * 4/2004 Lautner ..... 224/221
6,758,335 B2 * 7/2004 Kajiya ..... 206/320
6,772,879 B1 * 8/2004 Domotor ..... 206/45.23
6,785,566 B1 * 8/2004 Irizarry ..... 455/575.8
6,988,910 B2 * 1/2006 Gartrell ..... 439/527
7,180,735 B2 * 2/2007 Thomas et al. ..... 361/679.56
7,312,984 B2 * 12/2007 Richardson et al. ..... 361/679.41
7,464,814 B2 * 12/2008 Carnevali ..... 206/320
7,536,210 B1 * 5/2009 Morris et al. ..... 455/575.1
7,594,576 B2 * 9/2009 Chen et al. ..... 206/320
7,663,879 B2 * 2/2010 Richardson et al. ..... 361/679.56
7,891,220 B2 * 2/2011 Yen et al. ..... 70/63
7,933,122 B2 * 4/2011 Richardson et al. ..... 361/679.55
8,014,133 B2 * 9/2011 Dong et al. ..... 361/679.01
8,186,508 B2 * 5/2012 Fan ..... 206/320
8,186,726 B2 * 5/2012 Zuo ..... 292/57
8,251,408 B2 * 8/2012 Chen et al. ..... 292/80
8,259,445 B2 * 9/2012 Skillman et al. ..... 361/679.58
2007/0261978 A1 * 11/2007 Sanderson ..... 206/320
2009/0211775 A1 * 8/2009 Yamaguchi et al. ..... 174/50.5
2009/0312074 A1 * 12/2009 Liu et al. ..... 455/575.1
2012/0298536 A1 * 11/2012 Rauta et al. ..... 206/301
2012/0322516 A1 * 12/2012 Kitagawa et al. ..... 455/575.1

* cited by examiner

PROTECTIVE COVER FOR COMMUNICATION DEVICE

CROSS-REFERENCE TO RELATED APPLICATIONS

This application claims priority to currently U.S. provisional patent application No. 61/390,351, entitled "Protective Container for Communication Device," filed by the same inventor on Oct. 6, 2010, is a continuation-in-part application and claims priority to non-provisional application No. 13/018,929, filed by the same inventor on Feb. 1, 2011, entitled "Protective Container for Communication Device" which claims priority to currently U.S. provisional patent application No. 61/358,198, entitled "Protective Container for Communication Device," filed by the same inventor on Jun. 24, 2010, the contents of which are hereby incorporated by reference.

BACKGROUND OF THE INVENTION

1. Field of the Invention

This invention relates, generally, to protective containers. More particularly, it relates to a buoyant container that prevents cell phones and similar electronic mobile deices from sinking in water.

2. Description of the Prior Art

Cell phones and other mobile devices are not waterproof. Moreover, they are not protected from sand or dirt particles that may be present in an outdoor environment. Many people enjoy water-related and other outdoor sports and other activities, however, and their mobile devices may be dropped into water, subjected to sand particles, rain, and the like.

Thus there is a need for container for a mobile device that protects the device if splashed with water, submerged in water, or if subjected to sand, wind, rain and other environmental conditions that can degrade or destroy an electronic device.

The protective container should not only protect the mobile device, it should also enable a user to continue to use the device, unimpeded by the protective container.

However, in view of the art considered as a whole at the time the present invention was made, it was not obvious to those of ordinary skill in the art how the needed improvements could be provided.

SUMMARY OF THE INVENTION

The long-standing but heretofore unfulfilled need for a water-proof container for mobile devices is now met by a new, useful, and non-obvious invention.

The inventive structure is a water-proof container for holding a mobile device. The container includes a base adapted to support a mobile device, a cover, a hinge for interconnecting the base and cover to one another, and a locking mechanism for locking the cover to the base.

A groove is formed in an interior wall of the cover in circumscribing relation to the cover and a thin, transparent sheet of plastic has a bead formed in its peripheral edge. The bead is press fit into the groove so that the thin sheet of plastic closely overlies the operative face of the mobile device when the cover is latched to the base. A lock housing is pivotally mounted about a pivot pin having a first end that engages a wall of the base and a second end that engages the hollow lock housing at its center so that the lock housing rotates about the pivot pin.

A latch in the form of a protuberance is formed in and projects from a preselected wall of the cover. An opening is formed in the lock housing and faces the cover when the cover is unlocked. The opening has a width and depth sufficient to fully receive the protuberance when the cover is closed. A one hundred eighty degree (180°) rotation of the lock housing in a first direction positions the opening on an opposite side of the container 10, capturing the protuberance and thus causing the cover to tightly engage base, compressing the bead of the plastic sheet.

A one hundred eighty degree (180°) rotation of the lock housing in a second direction opposite to the first direction releases the protuberance and frees the cover from the base.

A second embodiment has a non-rotatable lock and a third embodiment has a lock housing at each end of the device.

The primary object of the invention is to protect mobile devices from water or airborne particulates that might damage the device.

A closely related object is to provide such protection without affecting a user's use of the mobile device.

These and other important objects, advantages, and features of the invention will become clear as this description proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF THE PREFERRED EMBODIMENT

Figure 1:
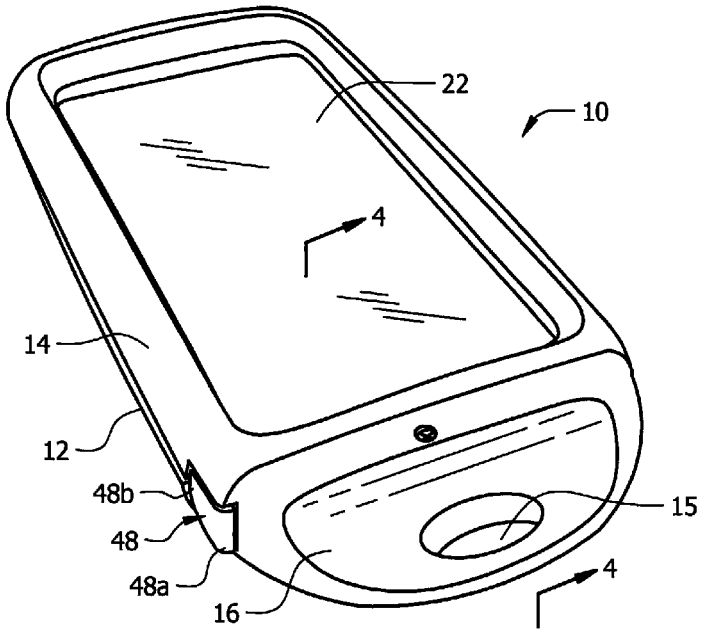
FIG. 1 is a perspective view of the novel container in its closed configuration.
Figure 2:
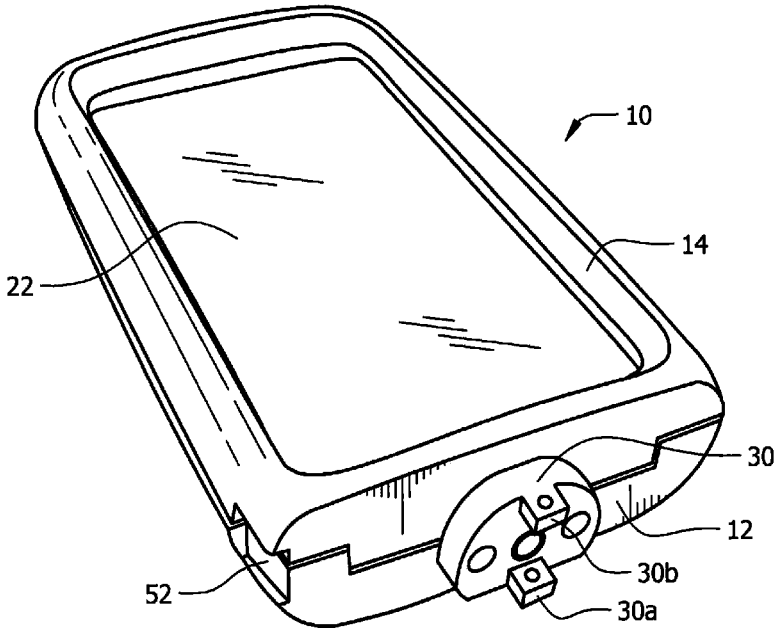
FIG. 2 is a perspective view with the locking handle removed.

FIG. 1 depicts an illustrative embodiment of the novel container which is denoted as a whole by the reference numeral 10.

Figure 3A:
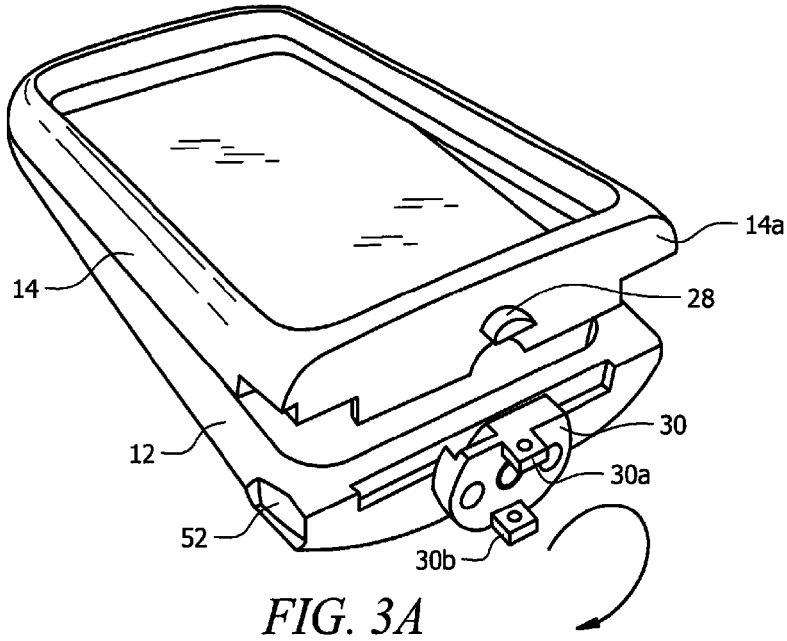
FIG. 3A is first exploded perspective view.
Figure 3B:
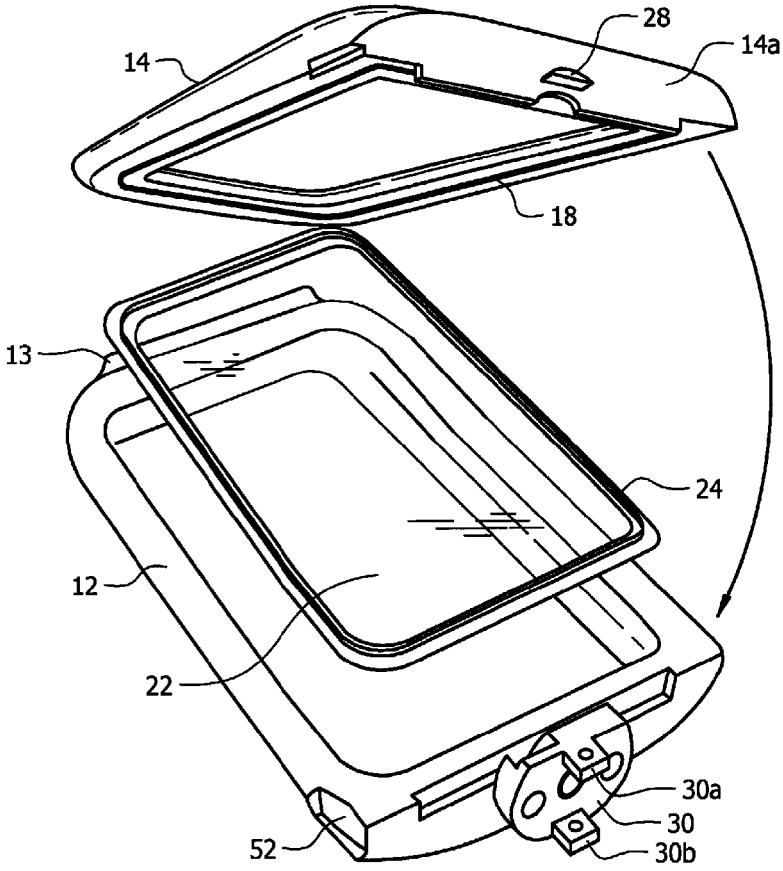
FIG. 3B is a second exploded perspective view.

In a first embodiment, protective container 10 includes a container base 12, a cover 14, a hinge 13 (FIG. 3B) for hingedly interconnecting the base and cover to one another, and a lock handle 16 for locking cover 14 to base 12.

Groove 18 circumscribes interior wall 20 of cover 14. A thin, transparent sheet of plastic 22 has bead 24 formed in its periphery and bead 24 is press fit into said groove so that said thin, transparent sheet of plastic closely overlies the operative face of a mobile device when cover 14 is locked to base 12.

Lock handle 16 is substantially hollow and is pivotally mounted about pivot pin 26 having boss 26*a*. More particularly, pivot pin 26 extends from transverse leading wall 12*a* of base 12 and engages central bore 31 of lock insert 30 (FIG. 5B) so that lock handle 16 rotates about pivot pin 26 when manually manipulated as more fully disclosed below.

Protuberance 28 (FIGS. 3A and 3B) projects from transverse leading wall 14*a* of cover 14. Opening 16*a* (FIG. 5A) is formed in rim 49 of lock handle 16 and said opening 16*a* faces cover 12 when protective container 10 is in its unlocked configuration. Opening 16*a* has a width and depth sufficient to fully receive protuberance 28 therewithin when cover 14 is closed. One hundred eighty degree (180°) rotation of lock handle 16 in a first direction positions opening 16*a* on the opposite side of protective container 10, thereby capturing protuberance 28, driving cover 14 towards base 12 and compressing bead 24.

More particularly, lock insert 30 (FIG. 5B) is slideably received within lock insert housing 20 of lock handle 16 so that lock insert 30 rotates conjointly with lock handle 16. Lock insert 30 has tabs 30*a*, 30*b* formed integrally therewith that are centrally apertured to receive screws and lock handle 16 has corresponding centrally apertured mounting bases 31*a*, 31*b* to which tabs 30*a*, 30*b* are respectively secured.

Lock insert housing 20 is supported in the center of lock housing 16 by a plurality of ribs or fins 33.

First annular wall 34 is formed in lock insert 30. First annular wall 34 terminates in featheredge wall 36 that is in open communication with opening 16*a* when the cover is unlocked.

Pivot pin base or boss 26*a* is circumscribed by pivot pin annular wall 38. Lock insert 30 is centrally apertured as at 31 to receive pivot pin 26.

Figure 5B:
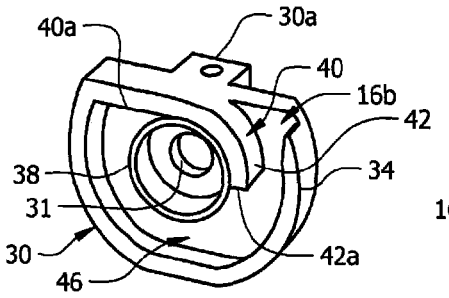
FIG. 5B is en enlarged perspective view of the locking handle insert.
Figure 5A:
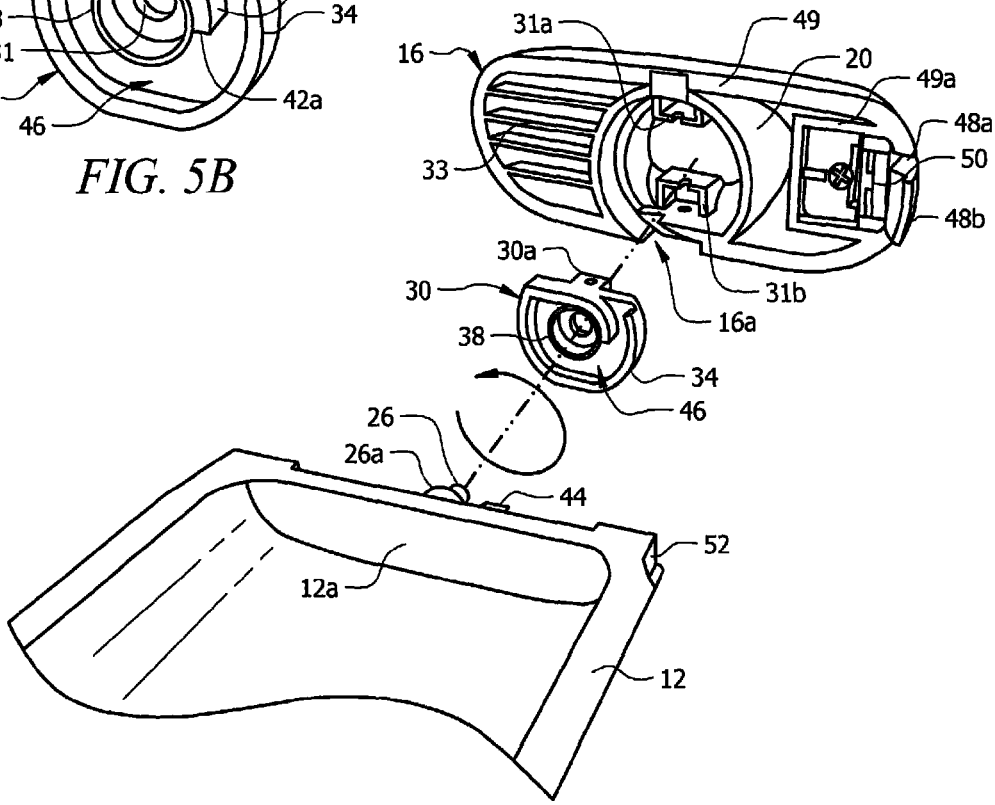
FIG. 5A is an exploded perspective view depicting the underside of the locking handle.
Figure 6A:
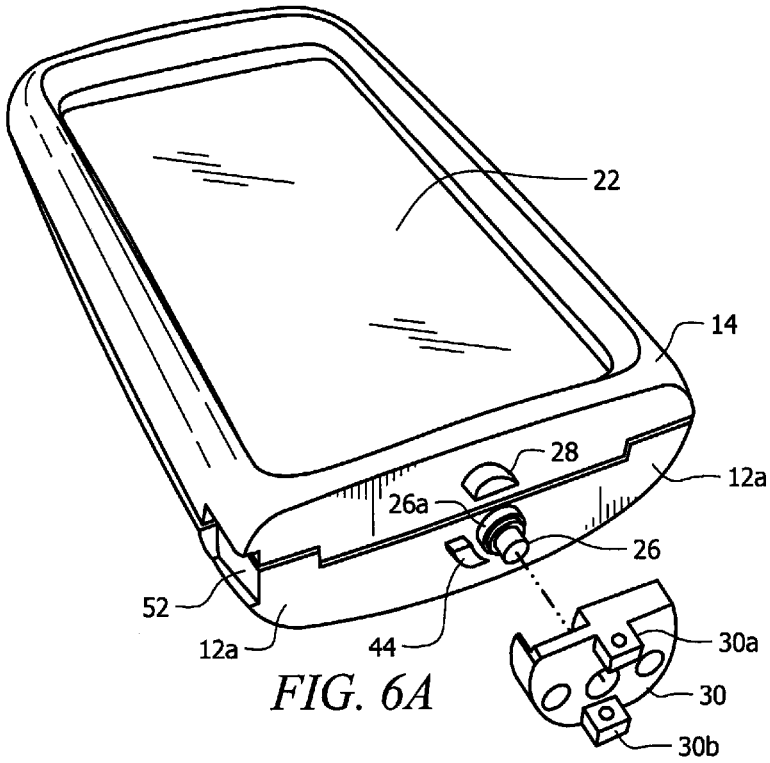
FIG. 6A is an exploded perspective view of the container and the locking insert in a first rotated position.
Figure 6B:
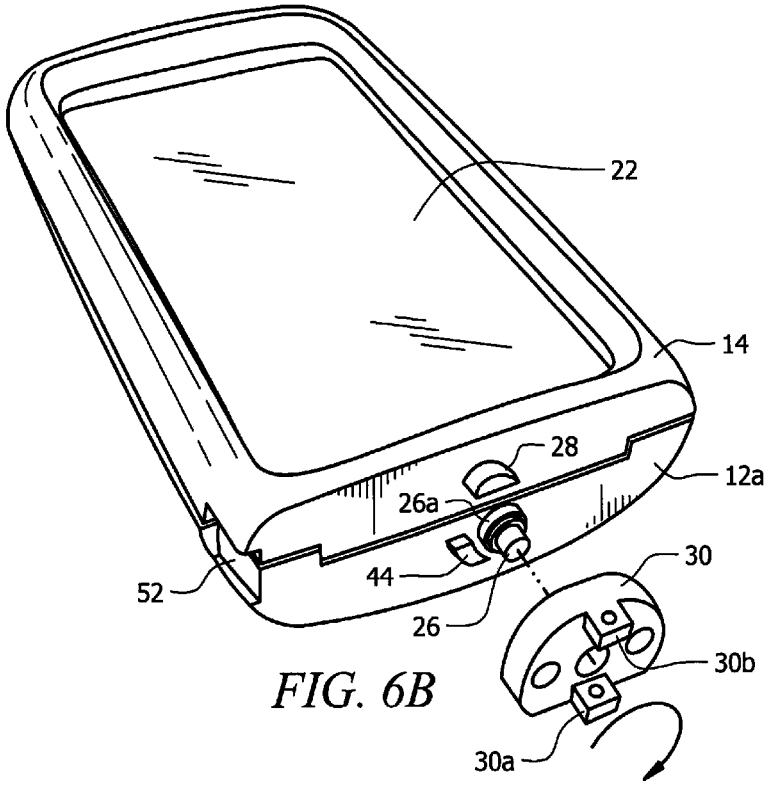
FIG. 6B is an exploded perspective view of the container and the locking insert in a second rotated position.

As depicted in FIGS. 5A and 5B, stop wall 40 of lock insert 30 has an irregular shape, including first end 42 that forms step 42*a*. Stop wall 40 wraps partially around pivot pin annular wall 38 and extends between said pivot pin annular wall and featheredge wall 36. Straight section 40*a* of stop wall 40 follows a straight path of travel and intersects first annular wall 34. It then follows the contour of said first annular wall 34 and terminates near opening 16*b* of lock insert 30. Said opening 16*b* is in open communication with opening 16*a* formed in lock handle 16 when cover 14 is unlocked. Rotation of lock handle 16 causes protuberance 28 to enter into groove 46 of lock insert 30.

Detent 44 is formed integrally with and projects from wall 14*a* of cover 14. Detent 44 abuts step 42*a* when lock handle 16 is in its unlocked configuration as best understood in connection with FIG. 5B. Detent 44 abuts straight section 40*a* of stop wall 40 when lock housing 16 is in its locked configuration as best understood in connection with said FIG. 5B. Thus, detent 44 is constrained within groove 46 at all times, bounded by step 42*a* and straight section 40*a* of stop wall 40. Protuberance 28 is also constrained within groove 46 when it is captured by slot 16*a* and handle 16 is rotated.

Lock housing 16 is locked in its locked position by hingedly mounted lock member 48. Lock member 48 has an "L" shape and is held in its closed position as depicted in FIG. 5A when short leg 48*a* of the L abuts protrusion 50 that is formed integrally with wall 49, mid-length thereof. Protrusion 50 firmly abuts a flat end of leg 48*a* when lock member 48 is urged into its locked position as depicted in FIG. 1 and such abutment prevents rotation of lock member 48. Lock member 48 is unlocked by manually rotating lock member 48 which causes transient displacement of wall 49 in a radially inward direction. Such abutment prevents unwanted opening of lock member 48 and thereby prevents inadvertent rotation of lock handle 16.

Recess 52 is formed in a side wall of cover 14 and in a side wall of base 12. Recess 52 accommodates lock member 48 when said lock member is in its locked position. When so accommodated, lock member is trapped within recess 52 and lock handle 16 cannot rotate about pivot pin 26. Lifting lock member 48 to allow such rotation requires that the force of protrusion 50 against the flat end of short wall 48*a* be manually overcome.

When fully locked, thin transparent sheet of plastic 22 closely overlies a mobile device housed within base 12 and covered by cover 14 so that a user may easily operate the device with the cover closed. The cover protects any electronic device therewithin from rain, splashed water, sand, dirt, and the like. It is also formed of buoyant materials so that it floats when dropped into water.

Figure 4:
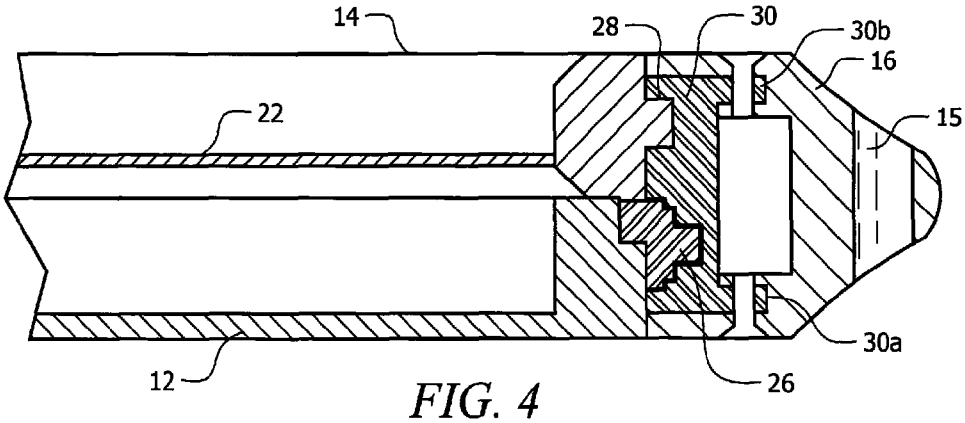
FIG. 4 is a sectional view taken along line 4-4 in FIG. 1.

Lock handle 16 also includes opening 16*b* (FIGS. 1 and 4) through which a distal end of a lanyard may be passed in order to tie said distal end to lock handle 16. The proximal end of such lanyard is advantageously attached to a user's belt or other item of clothing. This provides extra protection against sinking in deep water for mobile devices that are exceptionally heavy.

Figure 7:
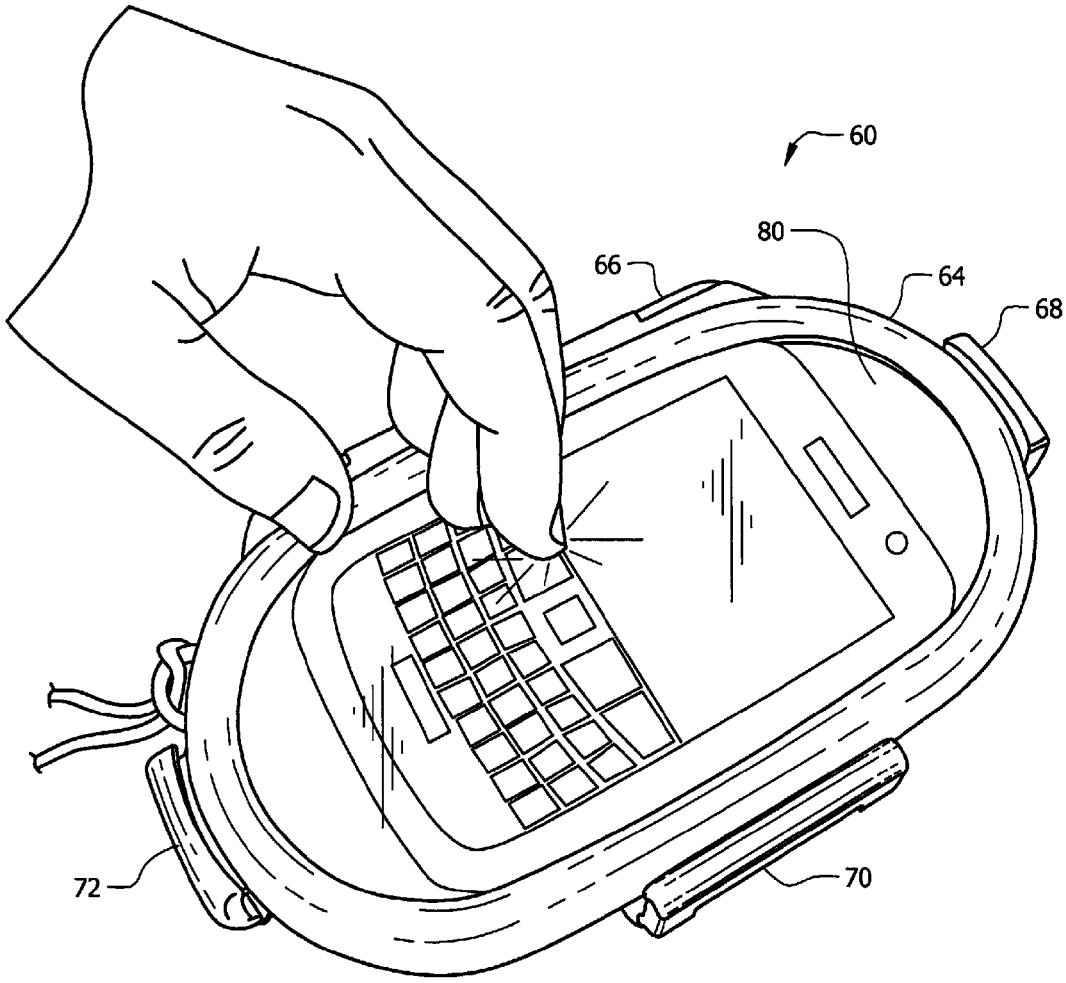
FIG. 7 is a perspective view of a second embodiment of the novel container when in its fully closed configuration and in use.
Figure 8:
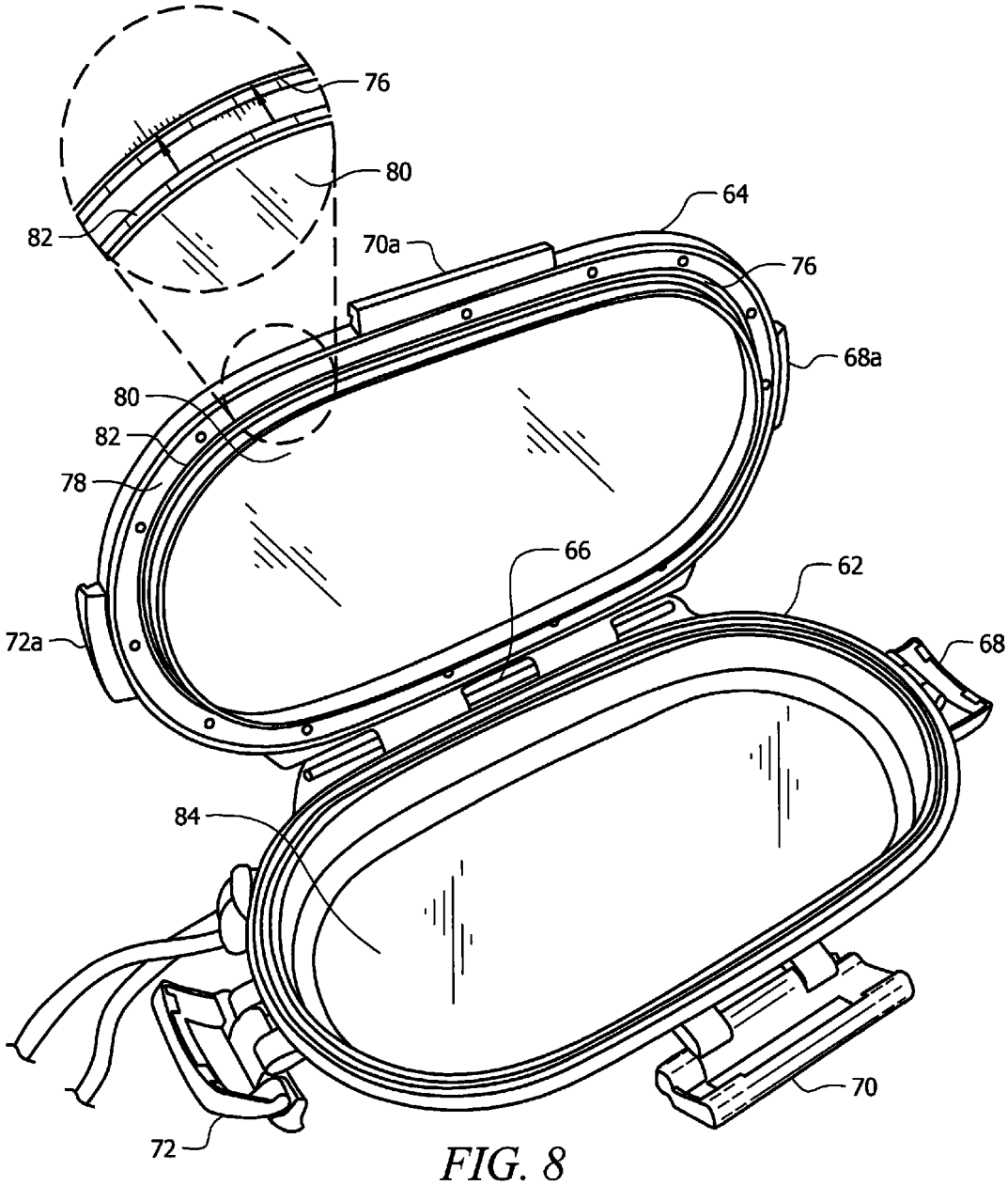
FIG. 8 is a perspective view of the second embodiment when in its open configuration.
Figure 9:
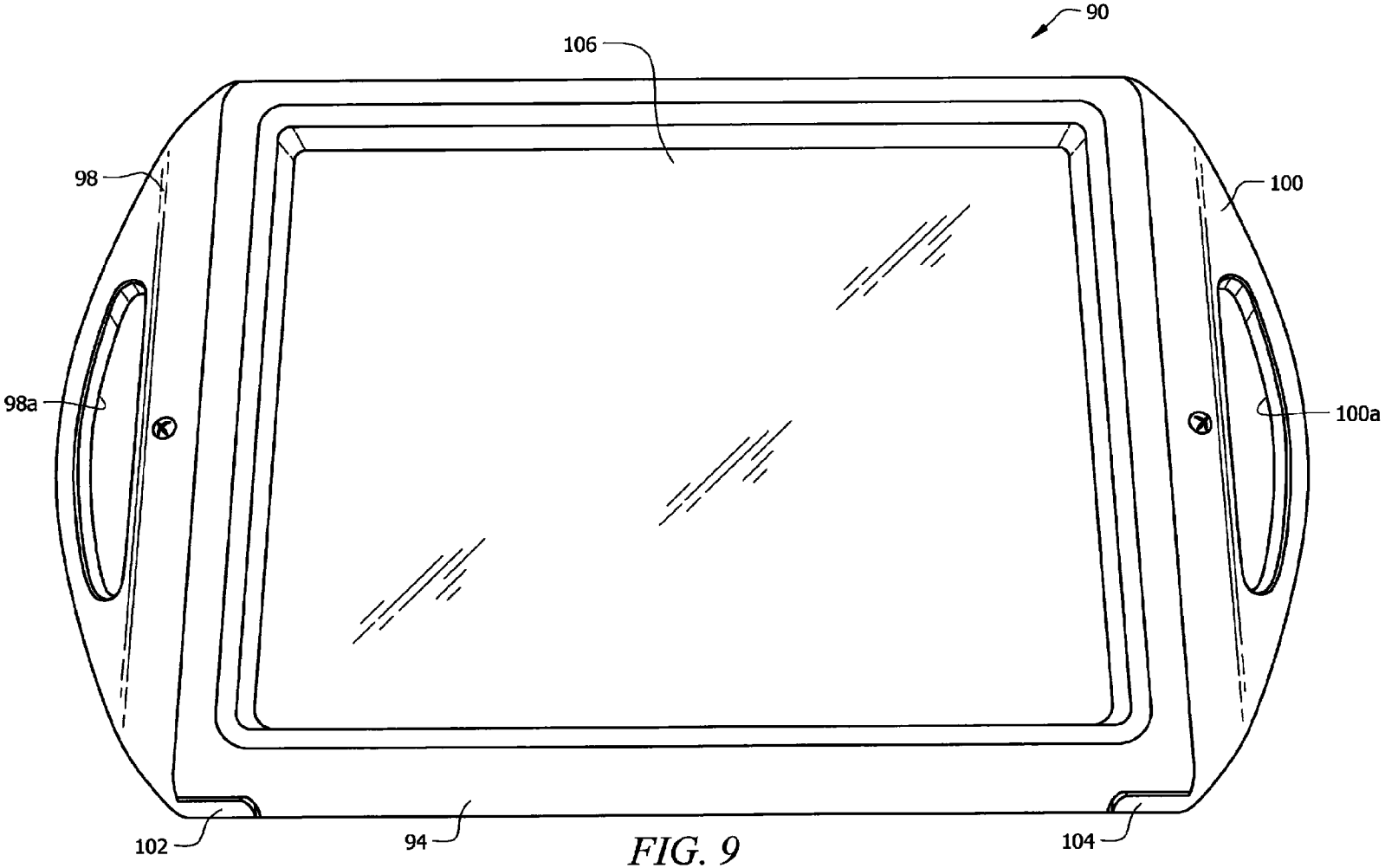
FIG. 9 is a perspective view of a second embodiment in its closed configuration.
Figure 10:
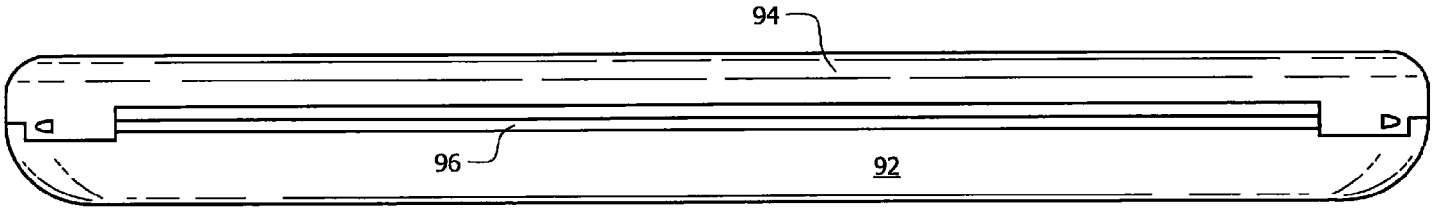
FIG. 10 is a front elevational view of the second embodiment.

In a second embodiment, depicted in FIGS. 7 and 8, protective container 60 includes a container base 62, a cover 64, a hinge 66 for hingedly interconnecting base 62 and cover 64 to one another, and a plurality of quick-release latches 68, 70, and 72 for releasably latching cover 64 to base 62. These latches are known as over-center latches in the industry. They require a catch formed on a first part of the two (2) parts to be latched together and a double-axle latch on a second part of said two (2) parts. More particularly, as depicted in FIG. 8, catches 68*a*, 70*a*, and 72*a* are associated with latches 68, 70, and 72, respectively.

Groove 76 circumscribes interior wall 78 of cover 64. A thin, transparent sheet of plastic 80 has bead 82 formed in its periphery and bead 82 is press fit into groove 76 so that said thin, transparent sheet of plastic closely overlies the operative face of a mobile device when cover 64 is locked to base 62.

In the first and second embodiments, a cell phone or other electronic device having a touch screen may be operated by touching the thin sheet of plastic. The plastic has a high coefficient of heat transfer so that heat travels quickly therethrough and normal operation of the device is not impaired. The device is waterproof and formed of a buoyant elastomeric material so that it will not sink if dropped into a body of water.

A third embodiment, denoted 90 as a whole, is depicted in FIGS. 9-14. It has utility in holding electronic devices that are substantially larger than a cell phone, such as an IPad® computer, for example. However, its structure is very similar to that of the first embodiment. It has a base 92 and a cover 94 that are interconnected to one another by hinge 96 (FIG. 10) along its length. It includes two lock handles 98, 100 that operate in the same way as lock handle 16 of the first embodiment. Openings 98*a*, 100*a* are formed in said lock handles, respectively.

Figure 11:
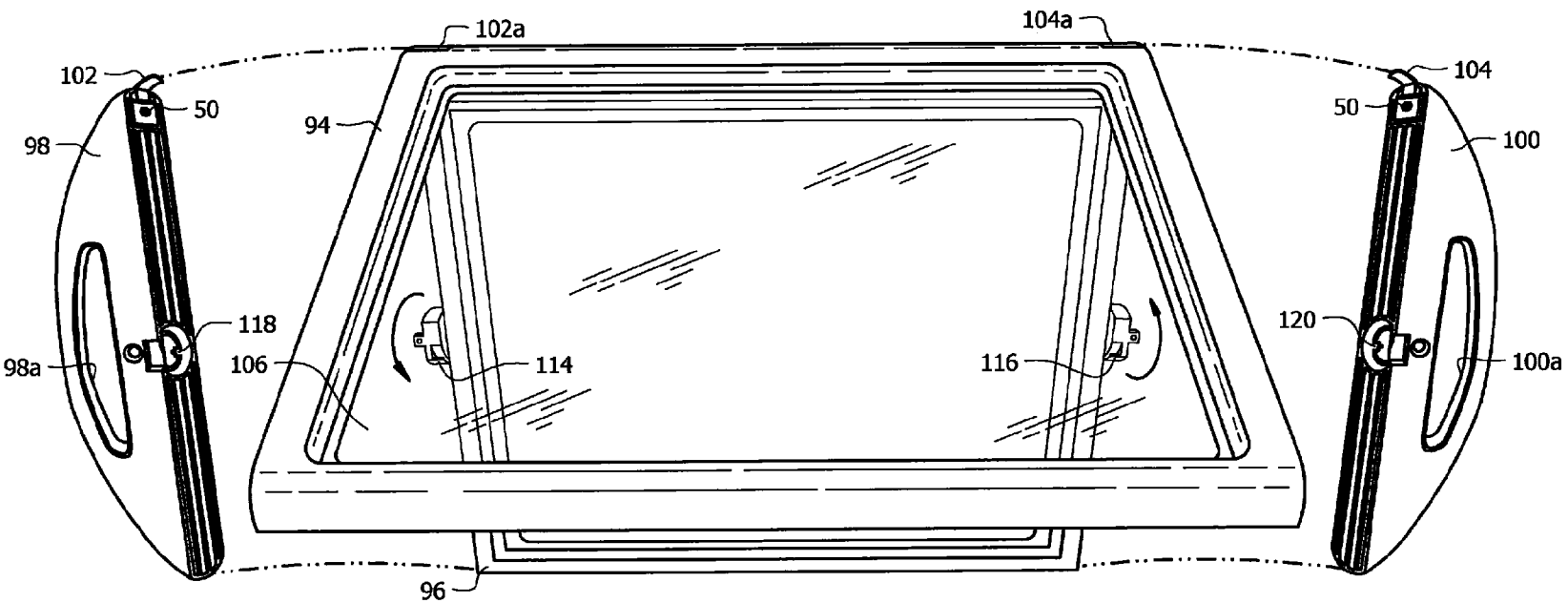
FIG. 11 is an exploded perspective view of the second embodiment when in an open configuration and indicating how the lock handles are rotated clockwise to unlock the structure.
Figure 12:
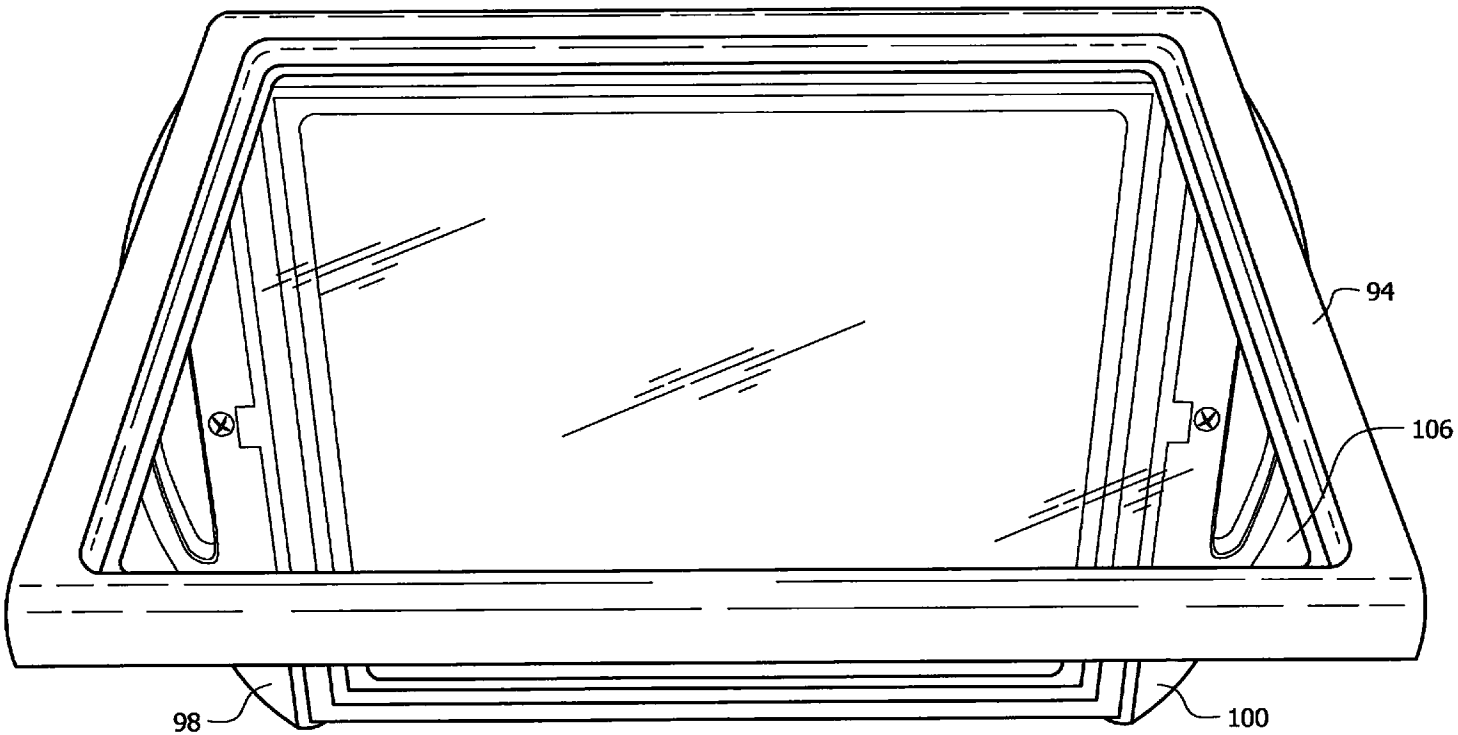
FIG. 12 is a perspective view depicting the second embodiment in an open configuration.

As indicated in FIG. 11, cover 94 is released from base 92 by rotating lock handle 98 clockwise, out of the plane of the paper, and by rotating lock handle 100 clockwise, into the plane of the paper. Most users will find such rotation intuitive. The rotation of the handles may take place at different moments in time but most users will intuitively rotate both handles at the same time.

As in the first embodiment, lock members 102, 104 prevent rotation of their respective lock handles 98, 100 when in their respective recesses. Recesses 102*a*, 104*a* are depicted in FIG. 11.

Also as in the first embodiment, a groove, not depicted in FIGS. 9-14, circumscribes the interior wall of cover 94. A thin, transparent sheet of plastic 106 has a bead formed in its periphery as in the first embodiment and said bead is press fit into said groove so that said thin, transparent sheet of plastic closely overlies the operative face of a mobile device when cover 94 is locked to base 96.

Lock inserts 114, 116 are the same as lock insert 30 in the first embodiment. Said lock inserts 114, 116 are slideably received within their respective enclosure walls 118, 120 that correspond to enclosure wall 32 of the first embodiment. In all respects, the locking and unlocking mechanism of the third embodiment is substantially the same as that of the first embodiment, the difference being merely the placement of the first and second lock handles at opposite ends of the container with the hinge running along a longitudinal edge thereof.

Figure 13:
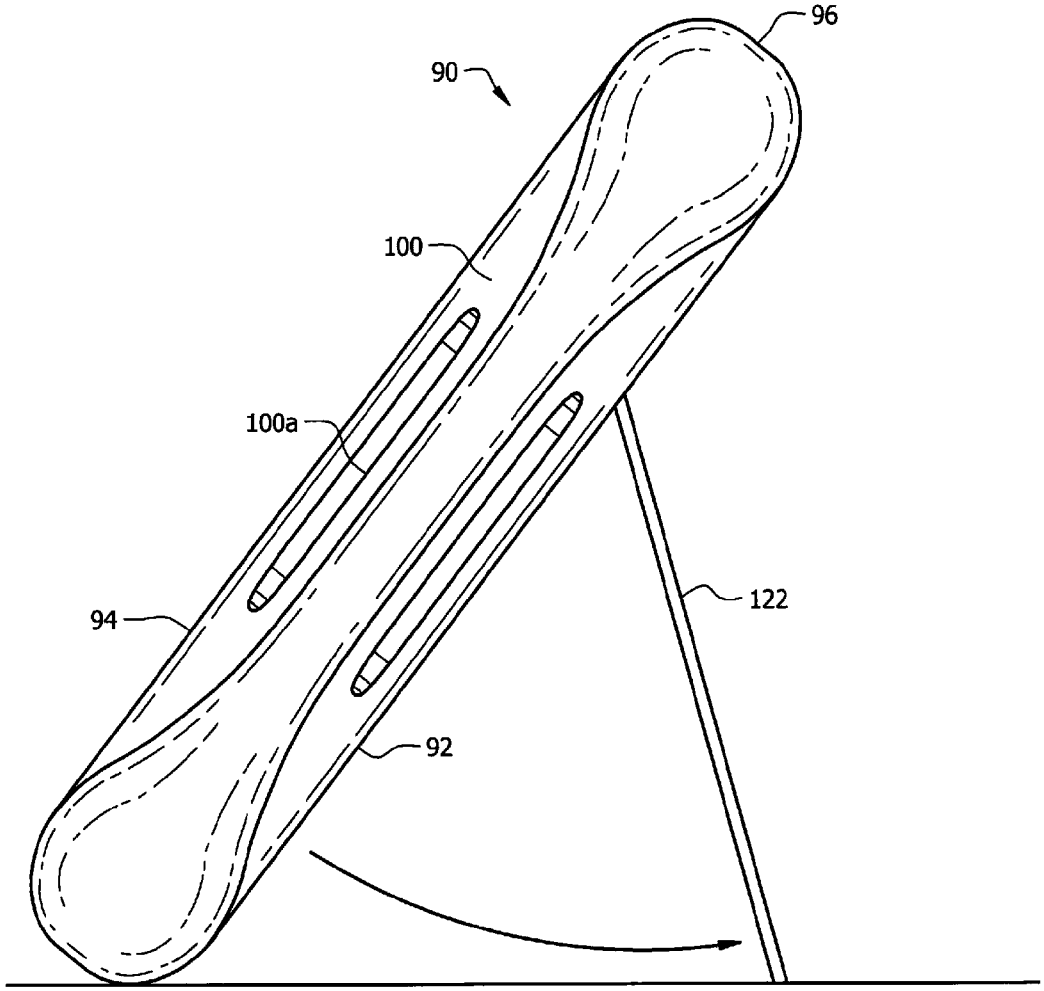
FIG. 13 is a side elevational view of the second embodiment when its stand is deployed.
Figure 14:
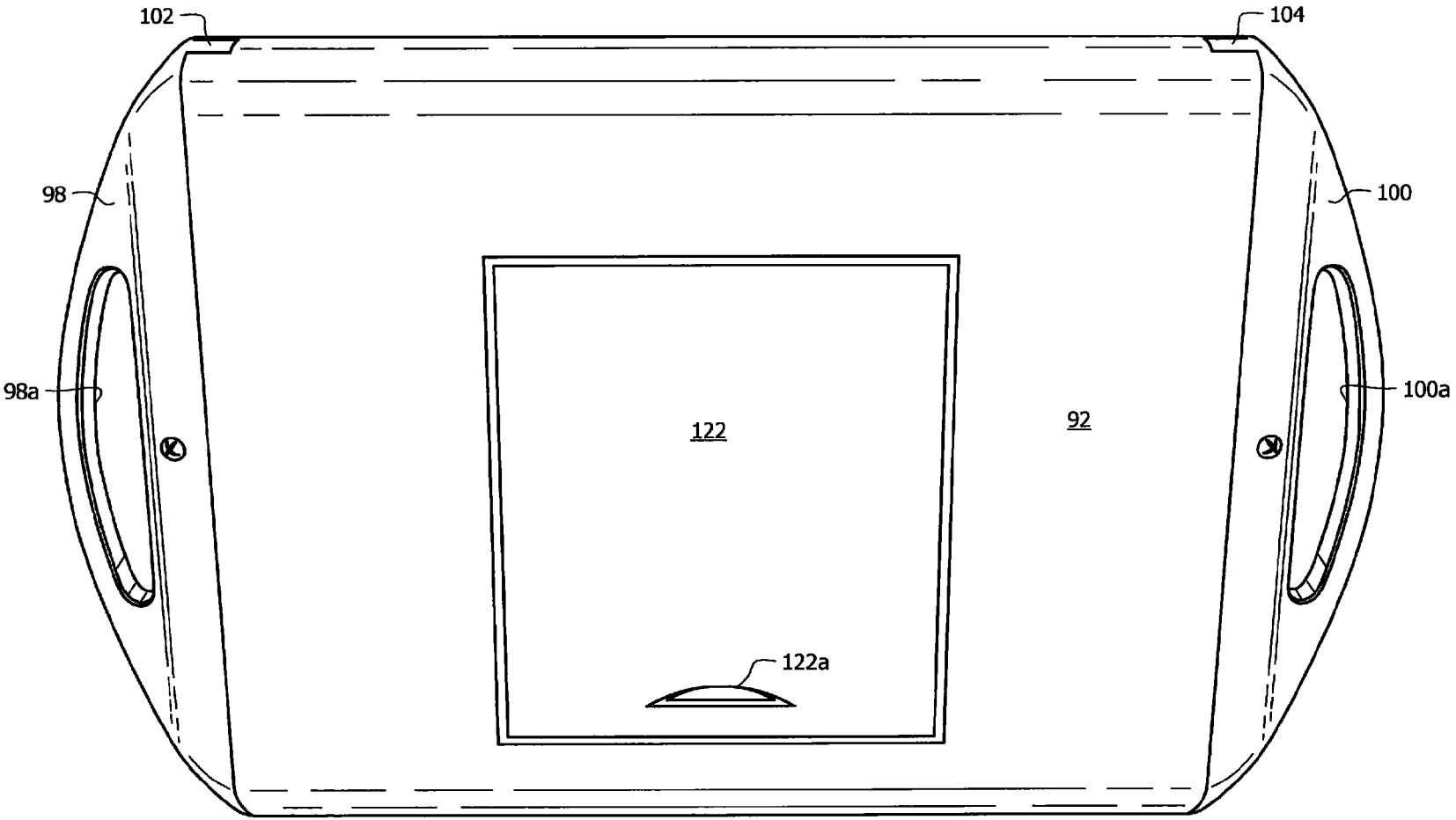
FIG. 14 is a rear perspective view of the second embodiment, depicting the stand in its closed position.

Brace 122 is hingedly mounted to a back wall of base 12 so that it can be deployed as depicted in FIG. 13 to support container 10 on a support surface at a preselected angle. Handle 122*a* that facilitates opening and closing of brace 122 is depicted in FIG. 14.

It will thus be seen that the objects set forth above, and those made apparent from the foregoing disclosure, are efficiently attained and since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A water-proof container for holding a mobile device, comprising:

a base adapted to support a mobile device;

said base including a flat, imperforate bottom wall of generally rectangular configuration having upstanding sidewalls integrally formed therewith, said upstanding sidewalls including a transversely disposed leading base wall and a transversely disposed trailing base wall;

each sidewall of said upstanding sidewalls having a flat to surface;

a cover that overlies said base, said cover including a frame-like rectangular structure including a top wall having depending sidewalls integrally formed therewith, said depending sidewalls including a transversely disposed leading cover wall and a transversely disposed trailing cover wall;

each sidewall of said depending sidewalls having a flat bottom surface that abuts said flat top surface of said upstanding sidewalls of said base when said cover overlies said base;

a hinge that interconnects said transversely disposed trailing base wall and said transversely disposed trailing cover wall;

lock housing for locking said cover to said base;

a groove formed in said flat bottom surfaces of said depending sidewalls of said cover;

a thin, transparent sheet of plastic;

a bead formed in a peripheral edge of said sheet of plastic, said bead being press fit into said groove so that said thin, transparent sheet of plastic closely overlies an operative face of said mobile device when said cover is locked to said base;

a protuberance formed in said transversely disposed leading cover wall;

a pivot pin mounted to and extending from said transversely disposed leading base wall, said pivot pin being centrally disposed relative to said transversely disposed leading base wall;

a detent mounted to and extending from said transversely disposed leading base wall, said detent being laterally spaced apart from said pivot pin;

said lock housing being rotatably mounted to said pivot pin;

said protuberance being captured within said lock housing when said lock housing is in a first, locked position, thereby preventing separation of said transversely disposed leading cover wall from said transversely disposed leading base wall and hence preventing separation of said cover from said base;

an opening formed in said lock housing, said opening being in open communication with said protuberance when said lock housing is in a second, unlocked configuration where said lock housing is rotated one hundred eighty degrees (180°) about said pivot pin relative to said first, locked configuration and said opening having a width and depth greater than a width and depth of said protuberance so that said protuberance is not captured by said lock housing when said lock housing is in said second, unlocked configuration and so that said cover may be rotated about said hinge to enable a mobile device to be removed from said container or inserted into said container when said lock housing is in said second, unlocked configuration;

said lock housing having a hollow interior;

a lock insert housing formed in the hollow interior of said lock housing;

a lock insert disposed within and secured to said lock insert housing;

a groove formed in said lock insert, said groove receiving said detent and constraining the travel of said detent so that a step formed in said groove blocks travel of said detent when said lock housing is in said unlocked configuration and so that a stop wall of said groove blocks travel of said detent when said lock housing is in said locked configuration; and said groove having an open end in open communication with said opening formed in said lock housing when said lock housing is in said unlocked configuration so that rotation of said lock housing from said unlocked configuration to said locked configuration causes said protuberance to enter into said groove, thereby preventing separation of said cover from said base.

2. The container of claim 1, further comprising:

a hingedly mounted lock member that locks said lock housing in a locked position so that said lock housing cannot rotate about said pivot pin;

said lock member having an "L" shape that includes a short wall and a long wall;

said lock housing having a lock housing recess formed therein in a preselected end thereof;

said short wall being hingedly mounted to said lock housing within said lock housing recess;

a base recess formed in a preselected sidewall of said upstanding sidewalls of said base;

a cover recess formed in a preselected sidewall of said depending sidewalls of said cover;

said lock housing recess, said base recess, and said cover recess collectively forming a lock member recess within which said lock member is positioned when said lock housing is locked against rotation about said pivot pin, said locked position of said lock member being its position of repose;

a protrusion member positioned within the hollow interior of said lock housing that is biased to extend toward said lock housing recess;

said protrusion member bearing against said short wall and urging said long wall of said lock member into said base recess and said cover recess due to said hinged mounting of said lock member;

whereby a user may unlock said lock housing by pulling said long wall out of said base recess and said cover recess, thereby causing the short wall to bear against the protrusion and to momentarily displace the protrusion away from said lock housing recess so that said long wall is rotated about ninety degrees (90°) from its position of repose, exiting said base and cover recesses, thereby enabling rotation of said lock housing about said pivot pin.

3. The container of claim 2, further comprising:

said container being formed of buoyant materials so that it floats when dropped into water;

whereby a user may operate the mobile device with the cover closed, said cover protecting said mobile device from rain, splashed water, sand, dirt, and the like.

4. The container of claim 3, further comprising:

an opening formed in said lock housing, said opening adapted to engage a distal end of a lanyard;

a proximal end of said lanyard adapted to be attached to an item of clothing of said user.

5. A water-proof container for holding a mobile device, comprising:

a base adapted to support a mobile device;

said base including a flat, imperforate bottom wall of generally rectangular configuration having upstanding sidewalls integrally formed therewith, said upstanding sidewalls including a transversely disposed leading base wall and a transversely disposed trailing base wall;

each sidewall of said upstanding sidewalls having a flat top surface;

a cover that overlies said base, said cover including a frame-like rectangular structure including a top wall having depending sidewalls integrally formed therewith, said depending sidewalls including a transversely disposed leading cover wall and a transversely disposed trailing cover wall;

each sidewall of said depending sidewalls of said cover having a flat bottom surface that abuts said flat top surface of said upstanding sidewalls of said base when said cover overlies said base;

a hinge;

said hinge interconnecting said base and cover to one another along a preselected longitudinal edge of the water-proof container;

a first protuberance formed in said transversely disposed leading cover wall;

a second protuberance formed in said transversely disposed trailing cover wall;

a first pivot pin mounted to and extending from said transversely disposed leading base wall, said first pivot pin being centrally disposed relative to said transversely disposed leading base wall;

a second pivot pin mounted to and extending from said transversely disposed trailing base wall, said second pivot pin being centrally disposed relative to said transversely disposed trailing base wall;

a first detent mounted to and extending from said transversely disposed leading base wall, said first detent being laterally spaced apart from said first pivot pin;

a second detent mounted to and extending from said transversely disposed trailing base wall, said second detent being laterally spaced apart from said second pivot pin;

a first lock housing rotatably mounted to said first pivot pin;

a second lock housing rotatably mounted to said second pivot pin;

said first protuberance being captured within said first lock housing when said first lock housing is in a first, locked position, thereby preventing separation of said transversely disposed leading cover wall from said transversely disposed leading base wall;

said second protuberance being captured within said second lock housing when said second lock housing is in a first, locked position, thereby preventing separation of said transversely disposed trailing cover wall from said transversely disposed trailing base wall;

a first opening formed in said first lock housing, said first opening being in open communication with said first protuberance when said first lock housing is in a second, unlocked configuration where said first lock housing is rotated one hundred eighty degrees (180°) about said first pivot pin relative to said first, locked configuration and said first opening having a width and depth greater than a width and depth of said first protuberance so that said first protuberance is not captured by said first lock housing when said first lock housing is in said second, unlocked configuration and so that said cover may be rotated about said hinge to enable a mobile device to be removed from said container or inserted into said container when said first lock housing is in said second, unlocked configuration;

a second opening formed in said second lock housing, said second opening being in open communication with said second protuberance when said second lock housing is in a second, unlocked configuration where said second lock housing is rotated one hundred eighty degrees (180°) about said second pivot pin relative to said first, locked configuration and said second opening having a width and depth greater than a width and depth of said second protuberance so that said second protuberance is not captured by said second lock housing when said second lock housing is in said second, unlocked configuration and so that said cover may be rotated about said hinge to enable a mobile device to be removed from said container or inserted into said container when said first lock housing is in its second, unlocked configuration and when said second lock housing is in its second, unlocked configuration;

said first lock housing having a hollow interior;

said second lock housing having a hollow interior;

a first lock insert housing formed in the hollow interior of said first lock housing;

a second lock insert formed in the hollow interior of said second lock housing;

a first lock insert disposed within and secured to said first lock insert housing;

a second lock insert disposed within and secured to said second lock insert housing;

a first groove formed in said first lock insert, said first groove receiving said first detent and constraining the travel of said first detent so that a step formed in said first groove blocks travel of said first detent when said first lock housing is in said unlocked configuration and so that a stop wall of said first groove blocks travel of said first detent when said first lock housing is in said locked configuration;

a second groove formed in said second lock insert, said second groove receiving said second detent and constraining the travel of said second detent so that a step formed in said second groove blocks travel of said second detent when said second lock housing is in said unlocked configuration and so that a stop wall of said second groove blocks travel of said second detent when said second lock housing is in said locked configuration;

said first groove having an open end in open communication with said first opening formed in said first lock housing when said first lock housing is in said unlocked configuration so that rotation of said first lock housing from said unlocked configuration to said locked configuration causes said first protuberance to enter into said first groove, thereby preventing separation of said cover from said base;

said second groove having an open end in open communication with said second opening formed in said second lock housing when said second lock housing is in said unlocked configuration so that rotation of said second lock housing from said unlocked configuration to said locked configuration causes said second protuberance to enter into said second groove, thereby preventing separation of said cover from said base;

a groove formed in said flat bottom walls of said depending sidewalls of said cover in circumscribing relation thereto;

a thin, transparent sheet of plastic;

a bead formed in a peripheral edge of said sheet of plastic, said bead being press fit into said groove so that said thin, transparent sheet of plastic closely overlies the operative face of said mobile device when said cover is latched to said base;

said cover being unlatched from said base by manual rotation of said first and second lock housings.

6. The container of claim 5, further comprising:

first and second lock members respectively having an "L" shape that includes a short leg and a long leg;

a first recess formed in said first lock housing and a longitudinally-extending sidewall of said base and said cover at a leading end of said container;

a second recess formed in said second lock housing and a longitudinally-extending sidewall of said base and said cover at a trailing end of said container;

said first and second lock members having an open position that enables separation of said base and cover from one another and a closed position that prevents separation of said base and cover from one another;

said first lock member being in said open position when the first lock member is pivoted so that the long leg of said first lock member is not disposed within said part of said first recess formed in said longitudinally-extending sidewall of said base and cover at said leading end of said container; and said second lock member being in said open position when the second lock member is pivoted so that the long leg of said second lock member is not disposed within said part of said second recess formed in said longitudinally-extending sidewall of said base and cover at said trailing end of said container;

a first protrusion slideably mounted in said first rotatably mounted lock housing;

said first protrusion being biased so that it extends into said first recess when in repose;

a second protrusion slideably mounted in said second rotatably mounted lock housing;

said second protrusion being biased so that it extends into said second recess when in repose;

said respective protrusions abutting a flat end of said respective short walls when said first and second lock members are urged into their respective locked positions, such respective abutments preventing unwanted opening of said first and second lock members;

said first and second lock members having respective unlocked, lifted positions that allows rotation of said first and second lock housings, respectively, said first and second lock members being respectively movable into said unlocked, lifted positions when the bias of said respective protrusions against respective flat ends of said short walls is manually overcome.

7. The container of claim 6, further comprising:

said cover being unlatched from said base by manual rotation of said first and second lock members in opposite directions to one another, said first lock member being rotated clockwise when said second lock member is rotated counterclockwise and said said first lock member being rotated counterclockwise when said second lock member is rotated clockwise.

* * * * *

UNITED STATES PATENT AND TRADEMARK OFFICE

CERTIFICATE OF CORRECTION

PATENT NO. : 8,453,835 B2
APPLICATION NO. : 13/019019
DATED : June 4, 2013
INVENTOR(S) : Kar Ming So It is certified that error appears in the above-identified patent and that said Letters Patent is hereby corrected as shown below:

In the Claims

Column 5, lines 63-64 (Claim 1, lines 9-10) should read as follows:
each sidewall of said upstanding sidewalls having a flat top surface;

Column 6, line 11 (Claim 1, line 24) should read as follows:
a lock housing for locking said cover to said base;

Signed and Sealed this
Fifteenth Day of October, 2013

Teresa Stanek Rea
*Deputy Director of the United States Patent and Trademark Office*